US006479013B1

(12) United States Patent
Sera et al.

(10) Patent No.: US 6,479,013 B1
(45) Date of Patent: Nov. 12, 2002

(54) CASTING COMPONENTS MADE FROM A TOOL STEEL

(75) Inventors: Tomoaki Sera, Nishinomiya (JP); Masahide Umino, Nara (JP); Kunio Kondo, Sanda (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 25 days.

(21) Appl. No.: 09/635,620

(22) Filed: Aug. 10, 2000

(51) Int. Cl.[7] ..... C22C 38/24; C22C 38/30; C22C 38/22

(52) U.S. Cl. ..... 420/69; 420/70; 420/37; 420/38; 420/39; 420/107; 420/111; 420/104; 148/325; 148/333; 428/685

(58) Field of Search ..... 420/69, 70, 37, 420/38, 116, 39, 105, 104, 107, 106, 111; 148/325, 333; 428/685

(56) References Cited

U.S. PATENT DOCUMENTS 5,069,870 A 12/1991 Iseda et al. ..... 420/70
5,240,516 A 8/1993 Iseda et al. ..... 148/325

FOREIGN PATENT DOCUMENTS

JP 402073951 A * 3/1990 ..... C22C/38/28
JP 11-152549 6/1999
JP 11-279702 10/1999
JP 2000-144334 5/2000

OTHER PUBLICATIONS

English abstract of Japanese patent 358125335A dated Jul. 26, 1983.*

English abstract of Japanese patent 404028849A dated Jan. 31, 1992.*

English abstract of Russian patent 596655A dated Feb. 9, 1978.*

* cited by examiner

*Primary Examiner*—Deborah Yee
(74) *Attorney, Agent, or Firm*—Clark & Brody

(57) ABSTRACT

A method of casting non-ferrous metals such as aluminum, magnesium, or zinc alloys uses casting components made from a tool steel comprising effective amounts of carbon, silicon, manganese, chromium, molybdenum, and vanadium, optional amounts of cobalt and increased level of molybdenum. Using the tool steel as a casting component, particularly as a mold, provides improvements in corrosion resistance, oxidation resistance, softening resistance, degradation resistance and deformation resistance. The tool steel casting component has a chromium oxide layer which is formed, in one mode, during the casting operation, to enhance the life and durability of the casting component and improve its casting performance.

16 Claims, 2 Drawing Sheets

CASTING COMPONENTS MADE FROM A TOOL STEEL

FIELD OF THE INVENTION

The present invention is directed to a method of non-ferrous casting using a tool steel, and casting components made from the tool steel, and in particular, to a tool steel casting mold that is extremely corrosion and seizure resistant when used in methods of non-ferrous metal casting.

BACKGROUND ART

When casting non-ferrous metals or alloys containing aluminum, magnesium, or zinc, consideration must be given to the adverse effects of corrosion and seizure on the components used during the casting process. To combat these effects, tool steels are used for the dies and the structural parts of the casting machines, injection molding machines, hot forging machines, and extrusion machines. Even so, when casting an aluminum alloy, the tool steel casting components, e.g., the molds, dies, cores, insert pins, supply pipes, gates, and the like of the casting apparatus, can prematurely corrode due to contact with the molten aluminum alloy. The corrosion can take the form of galling or seizing of the component. Such corrosion can then cause defects in the cast product, e.g., convex-type defects, and these defects can make it difficult to remove the cast product from the mold.

When casting non-ferrous alloys such as aluminum alloys, mold casting is often used. Mold casting can involve a number of different techniques such as permanent mold casting, low-pressure permanent mold casting, die casting, and squeeze casting. The type of mold casting used is dependent upon factors such as the shape and size of the article being manufactured, the required dimensional accuracy, the number of articles to be manufactured, the required quality, the required mechanical properties, and cost considerations.

Each of casting techniques noted above utilizes a different procedure to shape the molten non-ferrous metal. Permanent mold casting involves introducing a molten metal into a mold under the force of gravity. Low-pressure permanent mold casting applies a pressure to the surface of a molten metal, e.g., on the order of 0.01 to 0.03 MPa. The molten metal is then forced upward into a mold and against the force of gravity to fill the mold.

Die casting methods pour molten metal into a mold with the molten metal being under a pressure of about 40 to 100 MPa, or under gravity conditions.

Squeeze casting first introduces a molten metal into a mold in the absence of air. Then, a pressure of 50 to 120 MPa is applied and the molten metal is solidified.

In mold casting, particularly, low-pressure permanent and permanent mold casting, a mold coating is applied to the surface of the mold to protect the mold surface from the molten non-ferrous metal alloy. Typically, a mold coating is applied over the mold surface prior to casting as a means to facilitate cast product removal and to protect the mold. One example of prior art mold coatings generally comprises, in weight percent, about 40–50% of liquid glass, about 45–55% MgO, and about 5–10% water.

Each of the molds associated with these casting techniques suffers from some type of corrosion or other effect, which reduces the mold life span. In die casting, the molds can exhibit heat checking, cracking and erosion. Permanent and low-pressure permanent mold casting molds are susceptible to corrosion, and molds for squeeze casting suffer from heat checking and cracking.

In the past, steels for the manufacture of molds have typically been hot-work tool steels having a chromium content of about 5% by weight. However, these alloys do not always provide satisfactory corrosion or softening resistance, even with mold coatings. As such, prior art solutions have been proposed to overcome this problem.

One prior art solution to the corrosive effects of molten non-ferrous metals or alloys such as aluminum alloys is to surface treat the tool steel component by nitrocarburizing, and form a protective layer on the component. The problem with this solution is that the protective layer is eroded over time, and the layer on the tool steel component is eventually worn away, thus permitting corrosion to occur.

Other solutions in the prior art have been proposed through adjustments in the tool steel alloy composition. Japanese Publication No. 11-279702 teaches that the resistance against aluminum corrosion of a die-cast mold can be improved by the intentional addition of a large content of sulfur to a steel alloy composition containing carbon, silicon, manganese, chromium, molybdenum, vanadium, and iron.

Japanese Publication No. 2000-144334 provides another solution in the way of alloy composition adjustment. This publication teaches the combined addition of S and Te to improve resistance to aluminum corrosion during die casting in a steel alloy containing carbon, silicon, manganese, chromium, molybdenum, vanadium, and iron.

While the addition of sulfur or sulfur and tellurium improve corrosion, the level of sulfides are increased and toughness is lowered.

Another alloy composition proposed to alleviate aluminum corrosion in die casting components is a 5% chromium steel composition designated as H13 under the specification of the American Society for Testing and Materials. ASTM H13 is described in Japanese Publication No. 11-152549 as an alloy useful under high temperature conditions. However, the life of this alloy can be shortened by its insufficient resistance to softening at high temperatures, and lack of adequate heat-check and corrosion resistance. Japanese Publication No. 11-152549 also discloses an alloy with improved performance over the ASTM H13 alloy by providing a tool steel alloy composition wherein the composition consists of, in weight percent, 0.10–0.50% carbon, not more than 0.5% silicon, not more than 1.5% manganese, not more than 1.5% nickel, between 3.0 and 13.0% chromium, 0–3.0% molybdenum, 1.0–8.0% tungsten, 0.01–1.0% vanadium, 0.01–1.0% niobium, 1.0–10.0% cobalt, 0.003–0.04% boron, 0.005–0.05% nitrogen, with the balance iron and unavoidable impurities. The improved alloy is superior to softening at high temperatures in comparison to the ASTM H13 alloy due to the presence of cobalt, but cobalt reduces toughness. Further, this alloy's softening performance is still inadequate.

In spite of the advancements in tool steel alloy compositions, the presently available prior art tool steel alloys still suffer from inadequate resistance to molten aluminum alloy corrosion, excessive softening at high temperatures, and poor toughness. Accordingly, a need has developed to provide casting components that have increased resistance to corrosion and softening when exposed to non-ferrous casting conditions and better toughness.

The present invention solves this need through the discovery that a steel alloy intended for use in boiler tube construction unexpectedly provides superior performance when used as a casting component in methods of casting non-ferrous metals. Using this high chromium steel offers improved resistance to molten aluminum corrosion, resistance to degradation when the casting components are treated to remove unwanted material between casting sequences, and other benefits detailed below.

Boiler tube steel alloys are disclosed in U.S. Pat. Nos. 5,069,870 and 5,240,516 to Iseda et al., both hereby incorporated in their entirety by reference. However, neither of these patents teaches that the disclosed steels are suitable for use as a casting component in non-ferrous casting apparatus, nor do they recognize the benefits obtained when such steels are used to make casting components such as molds and used in non-ferrous casting methods.

SUMMARY OF THE INVENTION

Accordingly, it is a first object of the present invention to provide a tool steel which is ideally adapted for use as a casting component during the casting of non-ferrous metals.

Another object of the invention is a tool steel for use particularly in the casting of aluminum alloys into product shapes.

Yet another object of the invention is a method of casting non-ferrous metals wherein one or more components of the casting apparatus that come into contact with the molten non-ferrous metal comprises a steel containing carbon, manganese, silicon, phosphorous, sulfur, chromium, nickel, molybdenum, and vanadium, and optionally, cobalt, titanium, niobium, tungsten, copper, with the balance iron and inevitable impurities.

Yet another object of the invention is a tool steel for use as a mold in a non-ferrous casting method, particularly, methods that apply mold coatings to molds prior to casting and maintain the molds by shot blasting techniques after casting.

Other objects and advantages of the present invention will become apparent as a description thereof proceeds.

In satisfaction of the foregoing objects and advantages, the present invention provides an improvement in the components used in connection with the casting of non-ferrous metals. The invention, in one aspect, provides an improved casting component made from an alloy steel composition comprising, in weight percent, from about 0.05 to about 0.4% carbon; from about 0.10 to about 1.5 silicon; from about 0.1 to about 1.5% manganese; up to 2.0% nickel; from about 7.0 to about 15.0% chromium; up to 2.0% copper; up to 1.0% molybdenum; up to 3% tungsten; from about 0.05 to about 1.5% vanadium; up to 0.5% niobium; up to 0.1% aluminum; up to 0.1% nitrogen; up to 0.02% boron; up to 0.05% titanium; with the balance being iron and inevitable impurities. The casting component is one that comes into contact with the molten non-ferrous metal being cast and offers superb resistance to corrosion, oxidation, softening, checking, degradation, deformation, checking, and the like.

In a preferred embodiment, the steel composition includes, in weight percent, one or both of molybdenum from about 3 and 7% by weight and cobalt from about 1 to 10%. The casting component also has a chromium oxide layer adjacent a matrix formed of the steel composition of the casting component, the chromium oxide layer having a thickness ranging between about 1 and 30 microns. The chromium oxide layer is especially effective in providing the resistance to oxidation, corrosion, degradation, and deformation. The chromium layer can be the outermost layer of the component or be positioned between the matrix material and an iron oxide outer layer.

The casting component can be any type of a component used in casting of non-ferrous metals, including: a mold, a core, a sleeve, an insert for permanent mold casting; a stalk and mold for low-pressure permanent mold casting; and a plunger, a cylinder, a nozzle, a nozzle seat, a plunger tip, a ladle, a shot chamber, a tube, an ejection pin, a sprue spreader, and a ram for die casting.

The invention also entails the use of the casting component in a non-ferrous casting method wherein molten non-ferrous metal contacts one or more casting components and is cast into a desired shape. The casting method can be any known method used for casting of non-ferrous metals, but is preferably methods such as permanent mold casting, die casting, low-pressure permanent mold casting, and squeeze casting.

When employing a mold as the casting component, a portion of the mold designed to contact the molten non-ferrous metal can be coated with a mold coating as part of each casting sequence. When employing this mode of the invention, the mold coating contributes to formation of the chromium oxide layer during the casting operation and superior casting component performance.

While any non-ferrous metals can be employed as part of the inventive method, it is preferred to cast highly corrosive alloys such as aluminum-, zinc-, or magnesium-based alloys using the casting component composition noted above.

The casting component can be subjected to a metal removal process, e.g., shot blasting, between casting operations to prepare the surface for the next casting sequence. When utilizing a protective coating, the coating is then reapplied to the shot blast portion of the casting component for subsequent contact by the molten non-ferrous metal.

In yet another aspect of the invention, at least the corrosion resistance of casting molds is improved by forming the casting component as a mold, coating the mold with a mold coating, and forming the chromium oxide layer as part of the casting process. Use of the alloy steel composition as a mold and formation of the chromium oxide layer contributes to enhanced mold performance, both from a corrosion and softening resistance standpoint, and better maintenance of mold dimensional accuracy in spite of continued mold maintenance steps such as shot blasting.

BRIEF DESCRIPTION OF THE DRAWINGS

Reference is now made to the drawings of the invention wherein.

DESCRIPTION OF THE PREFERRED EMBODIMENTS

Figure 1:
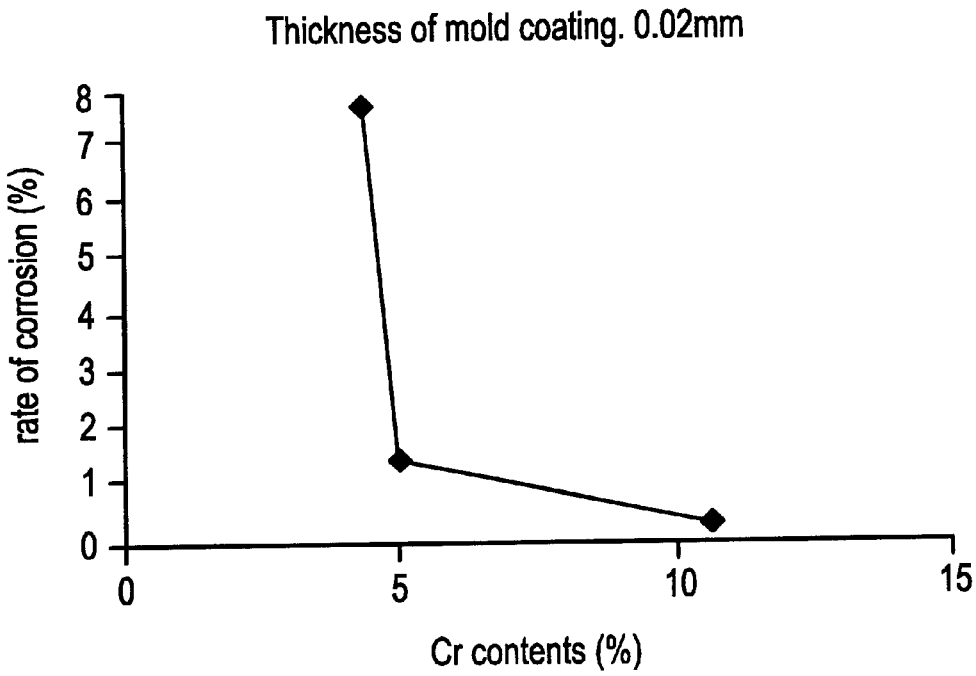
FIG. 1 is a graph comparing corrosion rates and three steel alloys when using a 0.02 mm mold coating.

The invention provides significant improvements in the field of casting non-ferrous metals. In the prior art, little advancement has been realized in terms of the materials used for casting components in non-ferrous metal casting techniques. The advancements in the prior art noted above still lack in providing a casting component that offers good resistance to the commonly found problems in casting, e.g., corrosion, softening, checking, cracking, erosion, oxidation, degradation, deformation, etc.

Surprisingly, the present invention provides a tool steel as a casting component which offers superior performance in molten metal corrosion resistance, softening resistance, oxidation resistance, heat checking, deformation resistance, and the ability to maintain dimensional accuracy of the casting component even when subjected to maintenance operations such as shot blasting.

The present invention attains these benefits by first forming the casting component from a steel composition comprising, in weight percent:

from about 0.05 to about 0.4% carbon, preferably from about 0.08% and 0.2%;

from about 0.10 to about 1.5 silicon, preferably from about 0.1% and 0.5%;

from about 0.1 to about 1.5% manganese, preferably from about 0.3% and 1.0%;

up to 2.0% nickel, preferably up to 1.0%;

from about 7.0 to about 15% chromium, preferably from about 10.0% and 13.0%;

up to 2.0% copper, preferably up to 1.0%;

up to 1.0% molybdenum;

up to 3% tungsten;

from about 0.05 to about 1.5% vanadium, preferably from about 0.05% and 0.5%;

up to 0.5% niobium, preferably from about 0.01% and 0.2%;

up to 0.1% aluminum, preferably up to 0.05%;

up to 0.1% nitrogen, preferably from about 0.02% and 0.08%;

up to 0.02% boron, preferably from about 0.0005% and 0.005%;

up to 0.05% titanium, preferably up to 0.02%;

with the balance being iron and inevitable impurities.

Impurities include up to 0.050% phosphorous; and up to 0.015% sulfur.

The carbon is maintained above the specified lower limit to keep resistance to softening, and below the upper limit to prevent forming carbides which lower toughness.

The silicon is maintained above the specified lower limit to improve machinability, and below the upper limit to prevent lowering of toughness.

The manganese is maintained above the specified lower limit to reduce δ ferrite that lowers toughness, and below the upper limit to avoid lowering of toughness and high temperature strength.

Nickel is effective to improve toughness, and it is necessary to keep the relation $Ni \geqq 0.25\ Cu$ for preventing copper checking. If nickel exceeds the upper limit, high temperature strength is lowered.

The chromium is maintained above the specified lower limit to improve resistance to softening, and below the upper limit to prevent forming carbides and lowering of toughness.

Copper is effective to improve toughness, but if the copper exceeds the upper limit, high temperature strength becomes lower.

Molybdenum is effective to increase resistance to softening, but molybdenum above the upper limit reduces toughness.

Vanadium is an important element that contributes to increased resistance to softening. If vanadium is below the lower limit, no effect of softening resistance is realized. If vanadium is beyond the upper limit, toughness is lowered.

Niobium is effective to increase resistance to softening, but niobium above the lower limit creates niobium carbides and lower toughness.

Aluminum is an effective deoxidizer, but is kept below the upper limit to avoid formation of large-size inclusions.

Nitrogen is an effective element in restricting δ ferrite formation which lowers toughness. Nitrogen is kept below the upper limit to avoid formation of blow holes during solidification, and scrapping of the cast product.

Boron effectively increases resistance to softening, but is kept below the upper limit to prevent formation of boron nitrides which lower toughness.

Titanium is a grain size refiner and improves ductility. The upper limit for titanium is maintained to avoid inclusion formation and lowering of toughness.

Phosphorous is controlled to the upper limit to avoid lowering of toughness, and sulfur is controlled to the upper limit to avoid formation of inclusions and toughness lowering.

If additional resistance to softening is required, additional amounts of molybdenum and cobalt can be added. From about 3 to 7% by weight of molybdenum is added for softening resistance and formation of Mo—Cr—Co intermetallics. Below 3% molybdenum does not give the added resistance to softening, and molybdenum lowers toughness when above 7%.

Likewise, cobalt improves softening resistance, and assists in formation of the Mo—Cr—Co intermetallics. From about 1 to 10% cobalt is preferred in this embodiment. Cobalt over the upper limit noted above lowers toughness, and too little cobalt does not give the added resistance to softening.

The casting component is intended to mean any component of a casting apparatus or device that comes into contact with molten non-ferrous metal and is need of resistance to one or more of corrosion, softening, oxidation, checking, cracking, deformation, degradation, and the like. Examples of components include molds, gates, molten metal supply pipes, dies, cores, insert pins, and the like. The invention is particularly suited for casting molds due to the discovery that the tool steel identified above provides particularly excellent resistance against molten metal corrosion, softening, oxidation, mold dimensional accuracy degradation, deformation of the mold, heat checking and cracking, and erosion. The invention is particularly suited for casting applications employing molds, wherein the molds are coated with a mold coating prior to contact with a molten non-ferrous metal.

Besides the discovery that the steel composition noted above provides vastly improved performance when used as a casting component in the casting of non-ferrous metals, it has also been discovered that improvements are realized in conjunction with formation of a chromium oxide film as part of the tool steel structure. This chromium oxide film covers the matrix material of the steel composition and has an effective thickness range of between about 1 and 30 microns. The chromium oxide film is adjacent the matrix material of the mold and can be either the outermost layer or be disposed beneath an outer layer of an iron oxide film. The chromium oxide layer inhibits the reaction between the molten non-ferrous metal, e.g., an aluminum alloy, and the tool steel surface of the mold. Layer thicknesses below 1 micron are insufficient to inhibit the reaction. Layers exceeding 30 microns in thickness exfoliate easily, and the newly developed surfaces then accelerate the reaction against the molten non-ferrous metal.

The chromium oxide layer can form as part of the casting component manufacturing process. Thus, the tool steel containing the layer is effective when used as a casting component in non-ferrous metal casting methods. If the casting component is a mold, the chromium oxide layer formed during manufacture would be effective during at least the first casting operation, and possibly others if the layer is still intact, or not removed by a maintenance operation.

As noted above, when the casting component is manufactured, the chromium oxide layer may form when the component is heated in an atmosphere of steam, hydrogen-steam, an endothermic gas, $CO$-$CO_2$ mixed gas, industrial Ar gas, and industrial $N_2$ gas. The chromium oxide layer may also be formed by heating a compound layer that has been formed by nitriding. In addition, the chromium oxide layer can form when the casting component is coated with a coating for protection as is conventionally done in the art. Coating the casting component is done particularly when the casting component is a mold.

Mold coatings are used to protect the mold from the adverse effects that can result from contact between the mold and the molten metal. If the mold coating is thin or absent, the corrosion of the mold can be severe. On the other hand, when the mold coating is large, e.g., greater than about 0.1 mm, corrosion does not take place. In many instances, the mold coating is between about only 0.02 and 0.04 mm, and the thickness is inadequate for protecting the mold.

In other instances, the mold coating may be removed after the casting sequence for maintenance of the mold. In these instances, shot blasting is normally employed to remove the mold coatings or non-ferrous alloys, e.g., aluminum alloys, which may remain on some portions of the mold after the casting is complete. The shot blasting is used to prepare the mold surface for the next casting operation. Although shot blasting is exemplified, other metal removal techniques can be employed to remove unwanted material on the mold or other casting component prior to reuse, e.g. etching, grinding, or the like.

When the mold or other component is subjected to shot blasting, the remaining cast alloy, mold coatings, and any oxide layer on the mold surface is removed. Generally, both the iron oxide and chromium oxide layer are removed as part of the shot blasting operation. Once these materials are removed, the mold is recoated with a mold coating and reused in a casting method.

One of the advantages of the invention is that the oxide layer formed on the casting component is thinner than that formed with prior art materials. Thus, the amount of oxide layer to be removed is minimized and an improvement in the precision of the dimensions of the mold is realized when using the composition specified above.

To better illustrate the effects of mold coating on corrosion, corrosion tests were performed using three alloys, a 4% Cr steel, a 5% Cr steel and a high chromium steel.

Table I compares corrosion rates for three steel alloys, and three thicknesses of mold coating, i.e., no coating or 0 mm, 0.02 mm, and 0.1 mm. The corrosion ratio value depicted in Table I is defined and determined as:

$$\text{Corrosion Ratio } (\%)=(A-B)/A\times 100,$$

wherein

B=Reduction in weight of the steel alloys by the removal of aluminum alloy by NaOH solution at the end of the test; and A=Weight of the steel alloy before the test The testing parameters were as follows:

The molten metal was an aluminum alloy A356 (Al-7Si-0.3 Mg);

The melt temperature was 720° C.;

The exposure time was 5 hours; and

The flow velocity was 4.4 m/min.

The test piece of the steel was contacted by the molten aluminum alloy. After the test was complete, the test piece was put in the NaOH solution to remove any aluminum alloy or other unwanted material stuck to the test piece. The test piece is weighed and the weight loss or corrosion ratio is determined using the formula noted above.

TABLE I

| | Thickness of mold coating | | |
|---|---|---|---|
| | 0.0 mm | 0.02 mm | 0.1 mm |
| Steel Type | Corrosion Ratio | | |
| 4% Cr Steel | 23.2 | 7.7 | — |
| 5% Cr Steel | 31.6 | 1.4 | 0.0 |
| Hi-Cr Steel | 32.8 | 0.3 | 0.0 |

Table I shows that when no mold coating is present, significant corrosion occurs for each alloy, and when the mold coating is 0.1 mm, no significant corrosion is realized. However, when the coating is 0.02 mm, significant corrosion is seen for the 4% and 5% chromium steels, whereas the high chromium steel exhibits negligible corrosion. This is a significant improvement over the prior art alloys, which corrode when the coating thickness is inadequate. Using the steel composition with effective amounts of chromium, etc. corrosion is minimal even with an inadequate mold coating.

FIG. 1 shows this effect graphically for the 0.02 mm mold coating. This Figure illustrates that the high chromium steel is vastly superior to the prior art steels when in contact with a molten non-ferrous metal. Thus, even when the mold coating is inadequate, the high chromium-casting component, e.g., the mold, has better resistance to molten metal corrosion.

One reason for the improvement in corrosion resistance is believed to be the formation of the chromium oxide layer in conjunction with the use of the high chromium steel as the casting component. As the mold coating is exposed to high temperatures, water in the mold coating oxidizes the mold surface. With a low chromium steel, e.g., 5% Cr, the oxide formed is primarily iron oxide. When using a high chromium steel, a chromium oxide layer is formed of a significant thickness, e.g., 2–4 microns. This chromium oxide layer has excellent anti-corrosion properties.

Figure 2A:
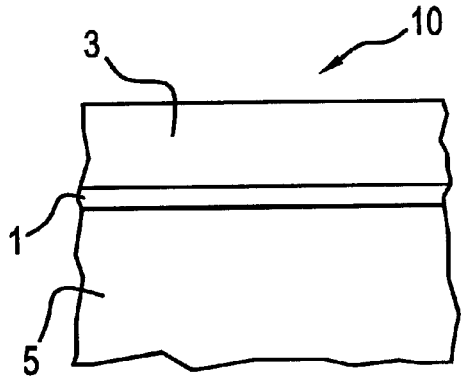
FIGS. 2*a* and 2*b* are partial schematics of a portion of a surface of a mold made from a high chromium tool steel.
Figure 2B:
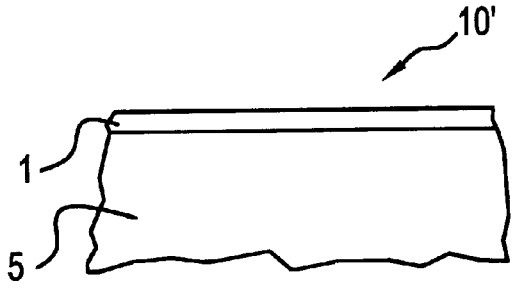

When measuring an actual mold, the chromium oxide layer was found to be 4 microns. The arrangement of the chromium oxide layer in combination with an iron oxide layer is schematically depicted in FIG. 2*a* and designated by the reference numeral 10. The chromium oxide layer 1 is shown between the iron oxide layer 3 and the matrix tool steel material 5. FIG. 2*b* shows the embodiment 10' wherein the chromium oxide layer 3 is the outermost layer and is adjacent the matrix material 5.

The casting component made from the alloy noted above is advantageous in its corrosion resistance against the effects of molten non-ferrous metals. In addition, the casting component has good oxidation resistance by virtue of the chromium oxide layer, and the dimensional accuracy of the component is maintained even though the component may be shot blasted for component maintenance.

The casting component also has higher resistance to softening compared with prior art casting component alloys, and less deformation of the casting component takes place during casting.

Figure 3:
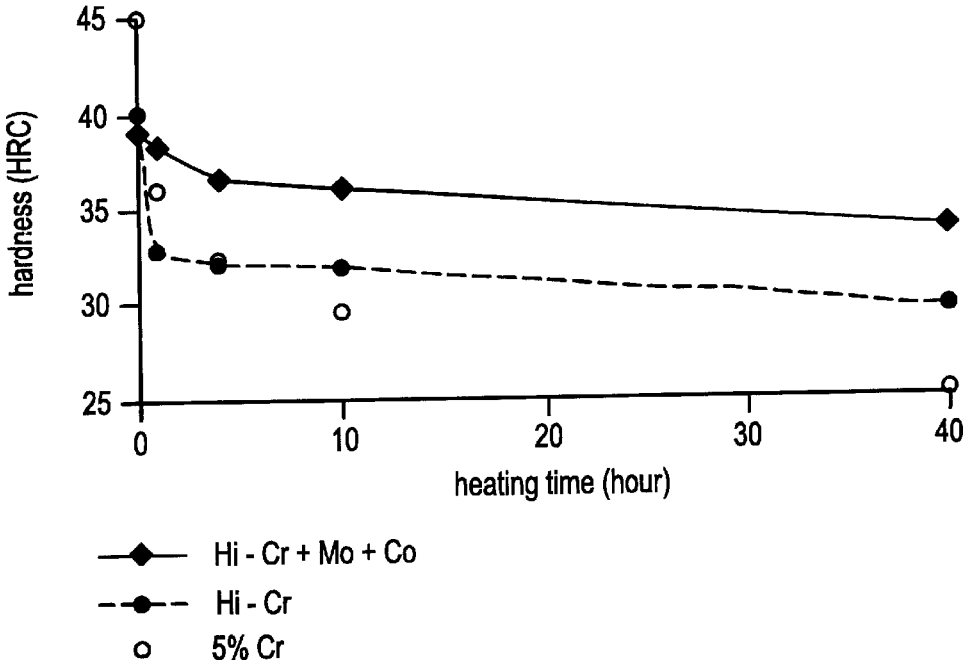
FIG. 3 is a graph comparing hardness over time for three chromium-containing steel alloys.

This increase in softening resistance is illustrated in FIG. 3. This Figure compares hardness versus heating time for a 5% chromium steel, a high chromium steel and a high chromium steel containing additional molybdenum and cobalt. It has been discovered that when molybdenum and cobalt are present in the casting component steel alloy, a Mo—Cr—Co intermetallic compound precipitates, and a marked increase in hardness or resistance to softening occurs. When investigating the hardness of a discarded mold that had been actually used, the high Cr steel had a Rockwell hardness of 30 HRC, the 5% Cr steel had a hardness of 24 HRC, and the molybdenum- and cobalt-containing high chromium steel had a hardness of almost 35 HRC. This indicates that the molybdenum- and cobalt-bearing high chromium steel exhibited much better resistance to softening than the other steels.

Figure 4:
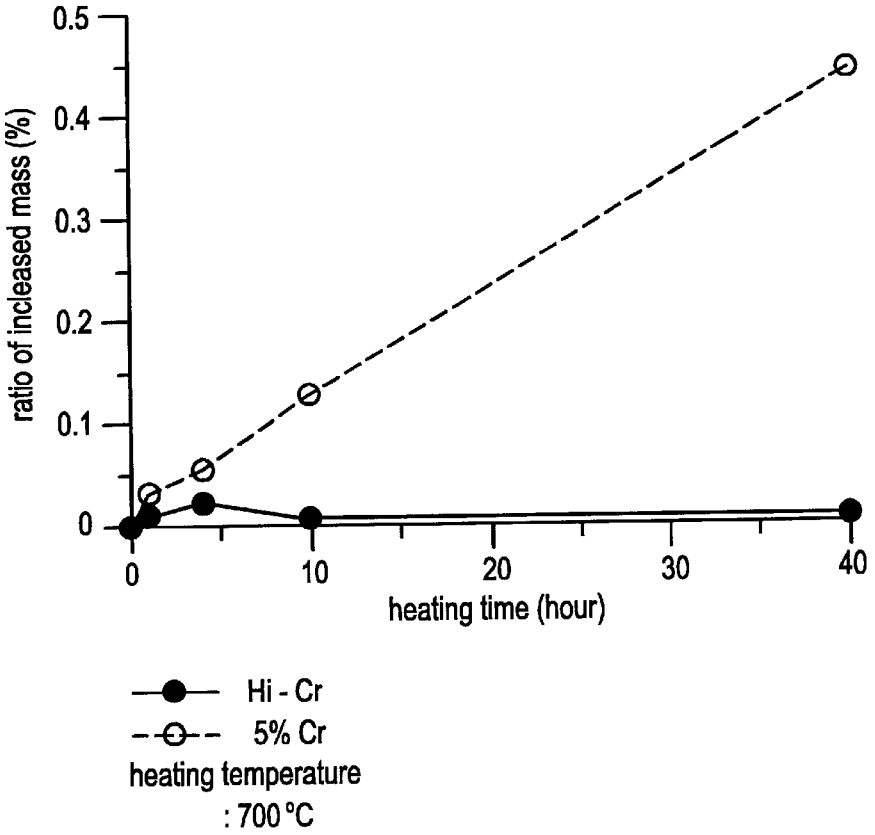
FIG. 4 is a graph comparing heating time and increased mass for two chromium-containing steel alloys.

FIG. 4 shows a comparison between a high chromium steel and a 5% chromium steel in terms of the ratio of increased mass in percent and the heating time when the materials are subjected to 700° C. temperatures. This Figure illustrates that the lower chromium steel has an increased mass over time at 700° C., thereby indicating that the oxide layer of the 5% Cr steel mold thickens over time. With this increase in thickness, the mold requires excessive shot blasting and the dimensional accuracy of the mold may be compromised or degraded. However, when using the tool steel composition noted above, the presence of the chromium oxide layer acts as a barrier to the shot blasting, thereby generally maintaining the mold dimensional accuracy. Thus, the mold has a longer life span and casting costs are lowered.

Table II shows exemplary compositions for casting components, particularly for molds. The first alloy exemplifies those having lower levels of molybdenum, levels of tungsten, and no or little cobalt. The second alloy exemplifies higher levels of molybdenum and cobalt, and no tungsten.

TABLE II

| Steel Composition in weight percent | | | | | | | | | | | | | | | | |
|---|---|---|---|---|---|---|---|---|---|---|---|---|---|---|---|---|
| C | Si | Mn | P | S | Cu | Ni | Cr | Mo | V | Nb | Co | Ti | W | B | N | Al |
| .13 | .30 | 0.59 | .014 | .001 | .86 | .37 | 10.55 | 0.35 | 0.19 | 0.05 | 0.04 | .002 | 2.09 | .0025 | .0615 | .009 |
| .10 | .31 | 0.64 | .002 | .001 | .01 | .68 | 10.65 | 4.13 | 0.18 | 0.01 | 7.05 | 0 | 0 | 0 | .0015 | 0 |

Although a mold coating is used in connection with a casting mold, the invention contemplates the use of a similar coating with casting components other than molds as part of a non-ferrous casting method. Further, while a coating is employed in the preferred embodiment, the invention contemplates a casting component made from the steel of the invention alone, e.g., without a coating, in a casting method or apparatus.

It should be understood that the casting component can be used in any conventional non-ferrous metal casting apparatus and method. Since the casting parameters and apparatus details are well known in the art, a detailed description is not necessary for understanding of the invention.

As such, an invention has been disclosed in terms of preferred embodiments thereof which fulfills each and every one of the objects of the present invention as set forth above and provides a new and improved method of casting non-ferrous metals using improved and more corrosion resistance casting components, a method of improving the corrosion resistance of casting molds, and improved casting components made from high chromium tool steel.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A casting component having at least one surface for contacting molten non-ferrous and made of a steel composition comprising, in weight percent:

from about 0.05 to about 0.2% carbon;
from about 0.10 to about 1.5 silicon;
from about 0.1 to about 1.5% manganese;
up to 2.0% nickel;
from about 7.0 to about 15% chromium;
up to 2.0% copper;
up to 1.0% molybdenum;
up to 3% tungsten;
from about 0.05 to about 1.5% vanadium;
up to 0.5% niobium;
up to 0.1% aluminum;
up to 0.1% nitrogen;
up to 0.02% boron;
up to 0.05% titanium;
up to 0.015% sulfur;
essentially no cobalt;

with the balance being iron and inevitable impurities.

2. The casting component of claim 1, further comprising a chromium oxide layer adjacent a matrix formed of the steel composition of the casting component.

3. The casting component of claim 2, wherein the chromium oxide layer is positioned between the matrix and an outer iron oxide layer.

4. The casting component of claim 1, wherein the casting component is one of a mold, a core, a sleeve, an insert, a stalk; a plunger, a cylinder, a nozzle, a nozzle seat, a plunger tip, a ladle, a shot chamber, a tube, an ejection pin, a sprue spreader, and a ram.

5. The casting component of claim 4, wherein the casting component is a mold.

6. The casting component of claim 5, wherein the mold has at least a portion covered with a mold coating that is applied to the casting component prior to molten non-ferrous metal contact with the mold portion as part of a casting method.

7. The casting component of claim 1, wherein the casting component has at least a portion covered with a protective coating that is applied to the casting component prior to molten non-ferrous metal contact with the casting component.

8. The casting component of claim 2, wherein the chromium oxide layer has a thickness ranging between about 1 and 30 microns.

9. A casting component having at least one surface for contacting molten non-ferrous and made of a steel composition comprising, in weight percent:

from about 0.05 to about 0.4% carbon;
from about 0.10 to about 1.5 silicon;

from about 0.1 to about 1.5% manganese;

up to 2.0% nickel;

from about 7.0 to about 15% chromium;

up to 2.0% copper;

from 3.0 to 7.0% molybdenum;

up to 3% tungsten;

from about 0.05 to about 1.5% vanadium;

up to 0.5% niobium;

up to 0.1% aluminum;

up to 0.1% nitrogen;

up to 0.02% boron;

up to 0.05% titanium;

from 1 to 10% cobalt;

up to 0.015% sulfur;

with the balance being iron and inevitable impurities.

10. The casting component of claim 9, wherein the casting component is one of a mold, a core, a sleeve, an insert, a stalk; a plunger, a cylinder, a nozzle, a nozzle seat, a plunger tip, a ladle, a shot chamber, a tube, an ejection pin, a sprue spreader, and a ram.

11. The casting component of claim 10, wherein the casting component is a mold.

12. The casting component of claim 11, wherein the mold has at least a portion covered with a mold coating that is applied to the casting component prior to molten non-ferrous metal contact with the casting component as part of a casting method.

13. The casting component of claim 9, wherein the casting component has at least a portion covered with a protective coating that is applied to the casting component prior to molten non-ferrous metal contact with the casting component.

14. The casting component of claim 9, further comprising a chromium oxide layer adjacent a matrix formed of the steel composition of the casting component.

15. The casting component of claim 14, wherein the chromium oxide layer is positioned between the matrix and an outer iron oxide layer.

16. The casting component of claim 14, wherein the chromium oxide layer has a thickness ranging between about 1 and 30 microns.

* * * * *